US007857411B2

(12) United States Patent
Ito

(10) Patent No.: US 7,857,411 B2
(45) Date of Patent: Dec. 28, 2010

(54) RECORDING APPARATUS

(75) Inventor: Koji Ito, Gifu (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 3 days.

(21) Appl. No.: 12/505,244

(22) Filed: Jul. 17, 2009

(65) Prior Publication Data

US 2010/0053250 A1 Mar. 4, 2010

(30) Foreign Application Priority Data

Aug. 29, 2008 (JP) ..... 2008-222222

(51) Int. Cl.
*B41J 29/38* (2006.01)

(52) U.S. Cl. ..... 347/16; 347/14; 347/19

(58) Field of Classification Search ..... 347/16
See application file for complete search history.

(56) References Cited

U.S. PATENT DOCUMENTS

| | | | | |
|---|---|---|---|---|
| 6,402,292 | B1 | 6/2002 | Ninomiya | |
| 2006/0114281 | A1* | 6/2006 | Otsuki | 347/19 |
| 2007/0002090 | A1* | 1/2007 | Arakawa | 347/16 |

FOREIGN PATENT DOCUMENTS

| | | | |
|---|---|---|---|
| JP | H04-039041 | A | 2/1992 |
| JP | H11-198395 | A | 7/1999 |
| JP | 2005-280027 | A | 10/2005 |
| JP | 2005-342899 | A | 12/2005 |

OTHER PUBLICATIONS

Japan Patent Office, Notification of Reason for Refusal in counterpart Patent Application No. 2008-222222, mailed Jun. 29, 2010.

* cited by examiner

*Primary Examiner*—Matthew Luu
*Assistant Examiner*—Brian J Goldberg
(74) *Attorney, Agent, or Firm*—Baker Botts L.L.P.

(57) ABSTRACT

There is disclosed a recording apparatus including a feeding mechanism, a recording head, a position sensor, a determining portion, and a recording-head controller. The feeding mechanism feeds a recording medium placed on a feeding surface. The recording head ejects a liquid droplet onto the recording medium on the feeding mechanism. The position sensor outputs a detection signal when the recording medium being fed by the feeding mechanism reaches a predetermined position, and also when a liquid-droplet ejection area formed at a part of the feeding surface reaches the predetermined position. The determining portion determines whether the liquid-droplet ejection area reaches the predetermined position. The recording-head controller controls the recording head such that: (i) when the detection signal is not outputted from the position sensor, the recording head does not eject a liquid droplet, (ii) when the detection signal is outputted from the position sensor and the determining portion determines that the liquid-droplet ejection area does not reach the predetermined position, the recording head records on the recording medium an image desired to be recorded on the recording medium, and (iii) when the detection signal is outputted from the position sensor and the determining portion determines that the liquid-droplet ejection area reaches the predetermined position, the recording head prints on the liquid-droplet ejection area an image desired to be printed on the liquid-droplet ejection area.

19 Claims, 5 Drawing Sheets

RECORDING APPARATUS

CROSS REFERENCE TO RELATED APPLICATION

The present application claims priority from Japanese Patent Application No. 2008-222222, which was filed on Aug. 29, 2008, the disclosure of which is herein incorporated by reference in its entirety.

BACKGROUND OF THE INVENTION

1. Field of the Invention

The present invention relates to a recording apparatus which records an image on a recording medium by ejecting liquid droplets onto the recording medium so as to form the image.

2. Description of Related Art

As an inkjet printer which records an image on a recording sheet as a recording medium by ejecting droplets of ink onto the recording sheet, there is known a printer having a feeding mechanism including an endless feeder belt wound around a plurality of rollers, and an inkjet head having a plurality of nozzles from which ink droplets are rejected onto a recording sheet placed on an outer circumferential surface of the feeder belt. In such an inkjet printer, it is known to inspect whether ink droplet ejection from the nozzles is normally performed, by ejecting ink droplets from the nozzles so as to print a test pattern on a part of the feeder belt, and then reading the test pattern by means of a line sensor that is disposed downstream of the inkjet head with respect to a sheet feeding direction which is a direction in which the recording sheet is fed. For example, such a technique is disclosed in JP-A-2005-342899.

On the other hand, in order to know the position of a recording sheet being fed, some inkjet printers have a sheet sensor for detecting the recording sheet reaching a predetermined position that is located upstream of an inkjet head with respect to a sheet feeding direction.

In the above-described technique of nozzle inspection, it is significant to have a surface of a portion of the feeder belt surface-treated in order to facilitate removal of the test pattern. However, where such a surface treatment is implemented in the inkjet printer having the sheet sensor described above, the following problem may arise. When the surface-treated part reaches the predetermined position, the sheet sensor detects the surface-treated part and erroneously outputs a detection signal indicative of detection of a recording sheet. The erroneous detection signal leads to recording of an image on the surface-treated part of the feeder belt, although the image should be recorded on a recording sheet.

SUMMARY OF THE INVENTION

This invention has been developed in view of the above-described situations, and it is an object of the invention, therefore, to provide a recording apparatus which can prevent erroneous recording of an image on a part of a feeder belt although the image should be recorded on a recording medium.

To attain the above object, the invention provides a recording apparatus including a feeding mechanism, a recording head, a position sensor, a determining portion, and a recording-head controller. The feeding mechanism feeds a recording medium placed on a feeding surface. The recording head ejects a liquid droplet onto the recording medium on the feeding mechanism. The position sensor outputs a detection signal when the recording medium being fed by the feeding mechanism reaches a predetermined position, and also when a liquid-droplet ejection area formed at a part of the feeding surface reaches the predetermined position. The determining portion determines whether the liquid-droplet ejection area reaches the predetermined position. The recording-head controller controls the recording head such that: (i) when the detection signal is not outputted from the position sensor, the recording head does not eject a liquid droplet, (ii) when the detection signal is outputted from the position sensor and the determining portion determines that the liquid-droplet ejection area does not reach the predetermined position, the recording head records on the recording medium an image desired to be recorded on the recording medium, and (iii) when the detection signal is outputted from the position sensor and the determining portion determines that the liquid-droplet ejection area reaches the predetermined position, the recording head prints on the liquid-droplet ejection area an image desired to be printed on the liquid-droplet ejection area.

According to the recording apparatus, when the detection signal is outputted from the position sensor and the determining portion determines that the liquid-droplet ejection area does not reach the predetermined position, the image desired to be recorded on the recording medium is recorded on the recording medium. On the other hand, when the detection signal is outputted from the position sensor and the determining portion determines that the liquid-droplet ejection area reaches the predetermined position, the imaged desired to be printed on the liquid-droplet ejection area is printed on the liquid-droplet ejection area. Thus, it is prevented that an image, which should be recorded on the recording medium, is erroneously recorded on the liquid-droplet ejection area.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described an inkjet printer as one presently preferred embodiment of the invention, by referring to the accompanying drawings.

Figure 1:
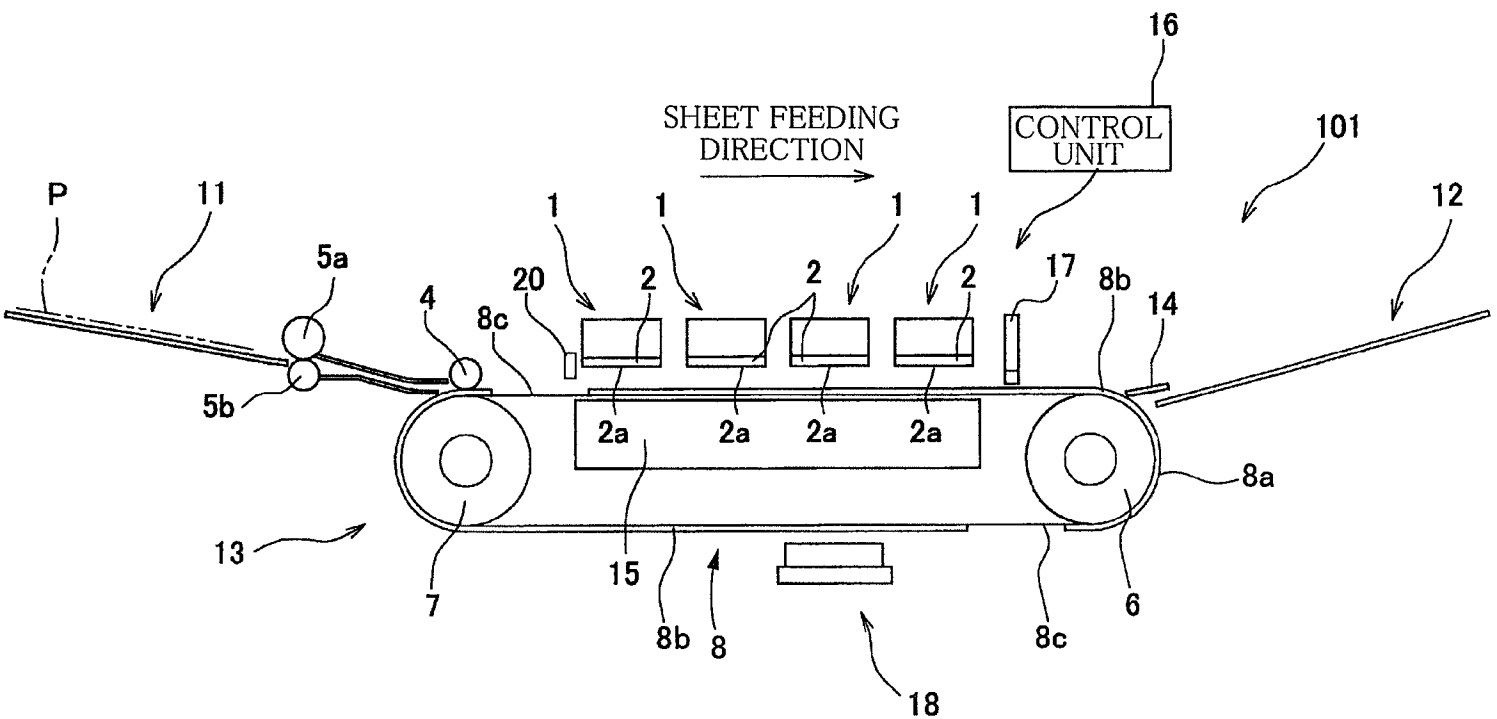
FIG. 1 is a schematic side view of an inkjet printer according to one embodiment of the invention.
Figure 2:
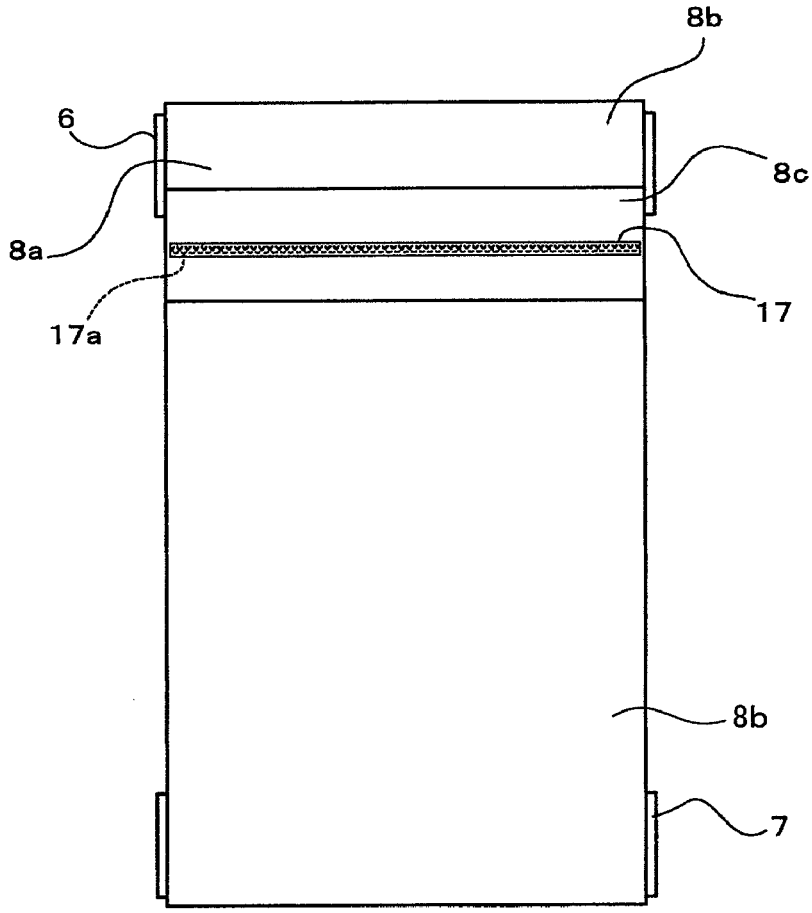
FIG. 2 is a top view of a part of the inkjet printer.

FIG. 1 is a schematic side view of the inkjet printer 101 and shows a general structure thereof. As shown in FIG. 1, the inkjet printer 101 is a color inkjet printer including four inkjet heads 1 (recording head). FIG. 2 is a view of a part of the inkjet printer 101 as seen from the upper side, but the inkjet heads 1 are not shown in FIG. 2. The inkjet printer 101 includes a control unit 16 for controlling operations of the inkjet printer 101. A sheet supply portion 11 and a sheet ejection portion 12 are formed in a left portion and a right portion of the inkjet printer 101 as seen in FIG. 1, respectively.

In the inkjet printer 101 is formed a sheet feed path along which a recording sheet P as a recording medium is fed from the sheet supply portion 11 to the sheet ejection portion 12. Immediately downstream of the sheet supply portion 11, a pair of pickup rollers 5*a*, 5*b* are disposed so as to nip therebetween a recording sheet. The pickup rollers 5*a*, 5*b* pick up a recording sheet P from the sheet supply portion 11 and feed it rightward as seen in FIG. 1 into the sheet feed path. With the pickup roller 5*a* is connected a sheet supply motor 35 (shown in FIG. 3) controlled by the control unit 16. By rotating the pickup roller 5*a* by the sheet supply motor 35, the recording sheet P is fed into a feeding mechanism 13 and placed on an outer circumferential surface 8*a* of a feeder belt 8.

The feeding mechanism 13 is disposed in an intermediate portion of the sheet feed path. The feeding mechanism 13 includes a pair of belt rollers 6, 7, the feeder belt 8, and a platen 15. The feeder belt 8 is an endless belt wound and entrained around the belt rollers 6, 7. The platen 15 is disposed inside the circle of the feeder belt 8 as seen in FIG. 1. With the belt roller 6 is connected a feed motor 19 (shown in FIG. 3) controlled by the control unit 16. By rotating the belt roller 6 by the feed motor 19, the feeder belt 8 travels or circulates. The feed motor 19 has a rotor as a rotatable portion disposed therein. Rotation of the rotor is transmitted via an output shaft of the feed motor 19 to the belt roller 6 connected with the output shaft of the feed motor 19. A rotary encoder 31 (shown in FIG. 3) as a pulse generator is attached to the output shaft of the feed motor 19. The control unit 16 counts pulses of signal from the rotary encoder 31 to obtain the rotational position of the rotatable portion of the feed motor 19, and accordingly the position of the feeder belt 8 with respect to the direction of circulation or traveling thereof. Hereinafter, this position will be referred to as "the traveling position". The rotary encoder 31 and a portion of the control unit 16 for counting the pulses of signal from the rotary encoder 31 cooperate to constitute a traveling-position detecting portion.

As shown in FIG. 1, the outer circumferential surface 8*a* of the feeder belt 8 includes two sheet holding areas 8*b* and two ink-droplet ejection areas 8*c*. The surface of each sheet holding area 8*b* is formed of a material having a weak adhesion, and a recording sheet P is placed on the surface of either of the sheet holding areas 8*b*. Each ink-droplet ejection area 8*c* corresponds to a bottom surface of a recess portion formed on the outer circumferential surface 8*a* of the feeder belt 8, and has a rectangular shape long in a width direction of the feeder belt 8. At the ink-droplet ejection area 8*c*, a test pattern is to be printed in a nozzle inspection which will be fully described later. The test pattern printed on the ink-droplet ejection area 8*c* is read by an image sensor 17 disposed downstream of the inkjet heads 1 in a sheet feeding direction in which the recording sheet is fed. The surface of the ink-droplet ejection area 8*c* is white in color in order to ensure a high degree of accuracy in the reading by the image sensor 17 of the test pattern printed on the ink-droplet ejection area 8*c*. The surface of the ink-droplet ejection area 8*c* is liquid-repellent treated in order that the test pattern printed is easily cleanable or removable by a cleaning mechanism 18. It is noted that the surface of the sheet holding area 8*b* has a color other than white, e.g., black. As shown in FIG. 1, the ink-droplet ejection areas 8*c* are formed at respective places on the outer circumferential surface 8*a* of the feeder belt 8, which are separate from each other with respect to a belt traveling direction in which the feeder belt 8 travels or circulates and which is parallel to the outer circumferential surface 8*a* of the feeder belt 8 and perpendicular to the width direction of the feeder belt 8. The ink-droplet ejection areas 8*c* have a same length in the belt traveling direction. The two ink-droplet ejection areas 8*c* formed on the outer circumferential surface 8*a* of the feeder belt 8 are spaced from each other equally with respect to the belt traveling direction. Thus, two sheet holding areas 8*b* are formed between the two ink-droplet ejection areas 8*c*, and the sheet holding areas 8*b* have a same length in the belt traveling direction. The length of the sheet holding area 8*b* in the belt traveling direction is longer than a length in the same direction of one of all the kinds of recording sheets to be placed on the outer circumferential surface 8*a* that has the largest length in the belt traveling direction of all the kinds of recording sheets to be placed on the outer circumferential surface 8*a*.

The platen 15 supports the feeder belt 8 at a position opposed to the inkjet heads 1 in order to prevent downward sagging of the feeder belt 8. At a position opposed and adjacent to the belt roller 7 is disposed a nip roller 4, which presses the recording sheet P as supplied from the sheet supply portion 11 by the pickup rollers 5*a*, 5*b* against the outer circumferential surface 8*a* of the feeder belt 8, thereby placing the recording sheet P thereon.

By rotating the belt roller 6 by the feed motor 19, the feeder belt 8 is circulated. While the feeder belt 8 is circulated, the sheet supply motor 35 is operated to rotate the pickup roller 5*a* in order to supply the recording sheet P onto the feeder belt 8. The recording sheet P thus supplied is placed on the outer circumferential surface 8*a* of the feeder belt 8 by the nip roller 4. The feeder belt 8 feeds to the sheet ejection portion 12 the recording sheet P adhesively held thereon. That is, on the outer circumferential surface 8*a* of the feeder belt 8, a silicon resin layer having a weak adhesion is formed.

Figure 4:
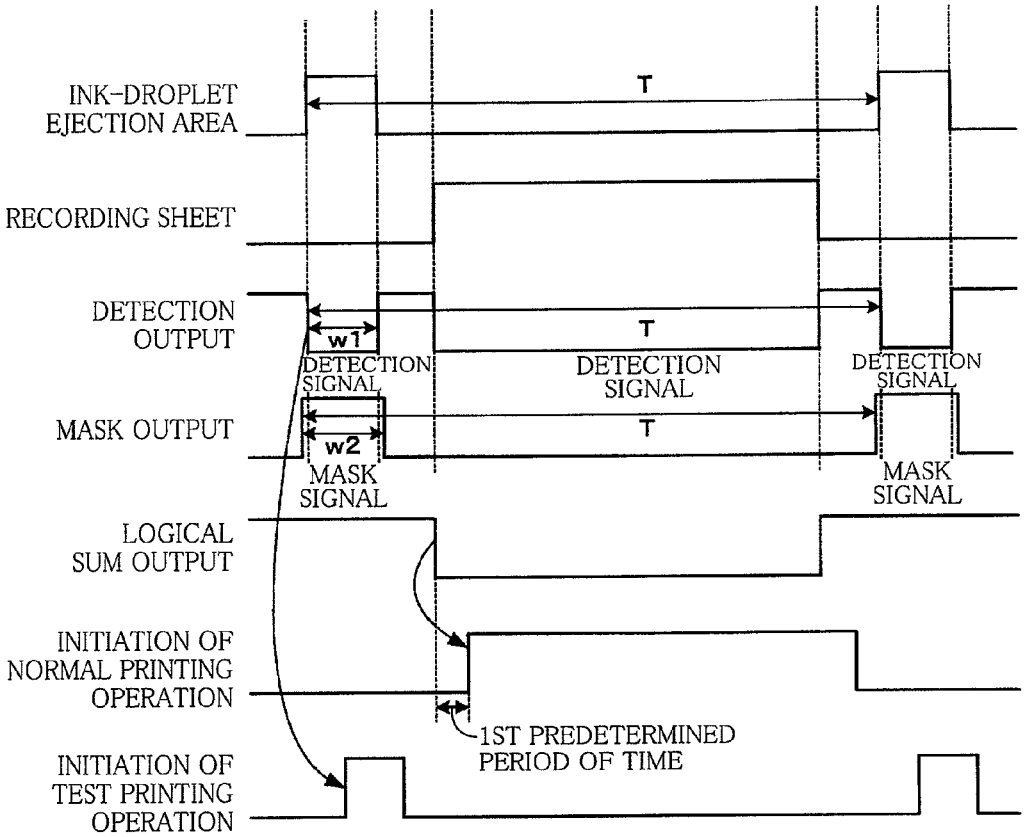
FIG. 4 is a time chart for illustrating an operation of the inkjet printer.

Immediately upstream of the inkjet heads 1 is disposed a position sensor 20 which is a reflective sensor for detecting change in the reflectivity of the outer circumferential surface 8*a* of the feeder belt 8. When a recording sheet P being fed by and on the feeder belt 8 reaches a predetermined position under the position sensor 20, the position sensor 20 outputs to the control unit 16 a detection signal in the form of a pulse which represents a change in the reflectivity. Also when either of the ink-droplet ejection areas 8*c* of the feeder belt 8 circulating or traveling reaches the predetermined position under the position sensor 20, the position sensor 20 outputs the detection signal in the form of a pulse. The pulse of the outputted detection signal has a width directly proportional to a time that is taken by an entirety of the recording sheet P or the ink-droplet ejection area 8*c* to pass through the predetermined position under the position sensor 20. In a case where the detection signal is outputted upon reaching of a recording sheet P under the position sensor 20, a falling edge of the outputted pulse corresponds to a timing at which a leading edge of the recording sheet P reaches the predetermined position, and a rising edge of the pulse corresponds to a timing at which a trailing edge of the recording sheet P have passed the predetermined position. Similarly, in a case where the detection signal is outputted upon reaching of either of the ink-droplet ejection area 8*c* under the position sensor 20, a falling edge of the pulse corresponds to a timing at which the leading end of the ink-droplet ejection area 8*c* reaches the predetermined position, and a rising edge of the pulse corresponds to a timing at which a trailing end of the ink-droplet ejection area 8*c* have passed the predetermined position. The width of the pulse outputted in the latter case, namely, where an ink-droplet ejection area 8*c* passes the predetermined position, is W1. As shown in FIG. 4, in both of the cases where a recording sheet P reaches the predetermined position under the position sensor 20 and where an ink-droplet ejection area 8*c* reaches there, the outputted detection signal uses negative logic.

Immediately downstream of the feeder belt 8 is disposed a separating plate 14, which separates, from the outer circumferential surface 8*a* of the feeder belt 8, the recording sheet P adhesively held thereon, and directs the recording sheet P rightward as seen in FIG. 1 to the sheet ejection portion 12.

Immediately downstream of the inkjet heads 1 is disposed the image sensor 17, which is a line sensor having a plurality of lenses 17*a* and a photodetector (not shown). The lenses are arranged in the width direction of the feeder belt 8, and the photodetector detects light coming from the lenses 17*a*. During the nozzle inspection described later, the image sensor 17 reads the test pattern printed on the ink-droplet ejection area 8*c*.

Under the feeder belt 8 as seen in FIG. 1, there is disposed the cleaning mechanism 18 that cleans the ink-droplet ejection area 8*c* after the nozzle inspection described later. The cleaning mechanism 18 includes a cleaning-liquid applicator 18*a* and a blade 18*b* (both shown in FIG. 5B). The cleaning-liquid applicator 18*a* is formed of a sponge material and holds a cleaning liquid supplied from a cleaning-liquid tank (not shown). The blade 18*b* is formed of an elastic material such as rubber or resin, and rectangular in shape. The cleaning-liquid applicator 18*a* and the blade 18*b* are disposed adjacent to each other in the width direction of the feeder belt 8. The cleaning mechanism 18 is movable by a moving mechanism (not shown) in a vertical direction and in the width direction of the feeder belt 8. The operation of the cleaning mechanism 18 will be fully described later.

The four inkjet heads 1 respectively corresponding to four color inks (i.e., magenta, yellow, cyan, and black inks) are arranged in the sheet feeding direction. That is, the inkjet printer 101 is a line printer. Each of the four inkjet heads 1 has a head mainbody 2 at its bottom. The shape of the head mainbody 2 is a rectangular parallelepiped that is long in a main scanning direction that is perpendicular to the sheet feeding direction. An under surface of the head mainbody 2 constitutes an ink ejection surface 2*a* opposed to the outer circumferential surface 8*a* of the feeder belt 8. In the ink ejection surface 2*a* are open a great number of nozzles from which ink droplets are to be ejected. While a recording sheet P being fed on and by the feeder belt 8 passes sequentially under the head mainbodies 2 of the four inkjet heads 1, droplets of the four color inks are ejected onto an upper surface, i.e., a recording surface, of the recording sheet P from the nozzles open in the ink ejection surface 2*a*, in order that a desired color image is formed within a recording area in the recording surface of the recording sheet P.

Figure 3:
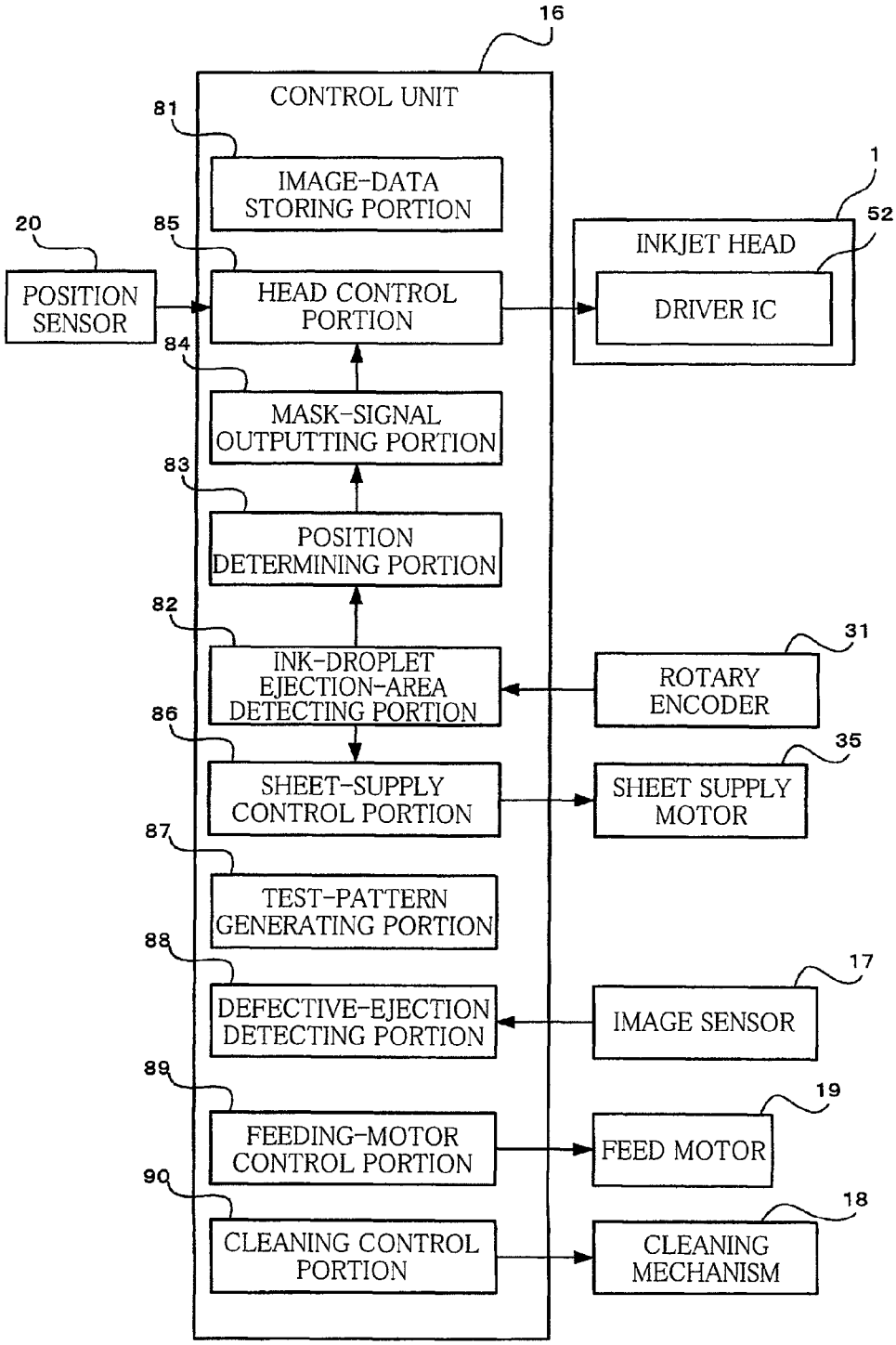
FIG. 3 is a functional block diagram of a control unit shown in FIG. 1.

Referring next to FIGS. 3 and 4, the control unit 16 will be described. FIG. 3 is a functional block diagram of the control unit 16. FIG. 4 is a time chart illustrating an operation of the inkjet printer 101. In FIG. 4, the pulse trains denoted by "ink-droplet ejection area" and "recording sheet" represent times during which the ink-droplet ejection areas 8*c* and a recording sheet P are respectively present or not present at the predetermined position under the position sensor 20. As shown in FIG. 3, the control unit 16 includes an image-data storing portion 81, an ink-droplet ejection-area detecting portion 82 (corresponding to a liquid-droplet ejection-area detecting portion), a position determining portion 83 (corresponding to a determining portion), a mask-signal outputting portion 84 (corresponding to a signal outputting portion), a head control portion 85 (corresponding to a recording-head controller), a sheet-supply control portion 86 (corresponding to a part of a placing mechanism), a test-pattern forming portion 87, a defective-ejection detecting portion 88, a feed-motor control portion 89, and a cleaning control portion 90.

There will be one by one described the functional portions of the control unit 16. The image-data storing portion 81 stores image data of an image desired to be recorded on a recording sheet P. The image data includes information of an amount of ink to be ejected for forming each dot of each color in the image.

The ink-droplet ejection-area detecting portion 82 determines the position of each ink-droplet ejection area 8*c* of the feeder belt 8 on the basis of the output from the rotary encoder 31. For instance, the determination of the ink-droplet ejection area 8*c* is made as follows. While the feeder belt 8 is circulated without feeding or holding thereon any recording sheet P, the position sensor 20 twice detects the ink-droplet ejection area 8*c* reaching the predetermined position. At the first detection, that is, when the position sensor 20 first detects the ink-droplet ejection area 8*c*, the number of pulses from the rotary encoder 31 counted is reset or zeroed. While the feeder belt 8 is further kept circulated, the second detection is made, that is, the position sensor 20 detects the next ink-droplet ejection area 8*c*. The number of the pulses counted between the moment of the reset and the moment of the detection of the next ink-droplet ejection area 8*c* is stored. Thus, the ink-droplet ejection-area detecting portion 82 determines the position of the ink-droplet ejection area 8*c* on the basis of the stored number of pulses counted. In order to enhance the degree of precision in the determination of the position of the ink-droplet ejection area 8*c*, the number of counted pulses may be determined by averaging a plurality of the numbers of counted pulses obtained by repeating a plurality of times the process of pulse counting as described above.

By making a comparison between the thus decided and stored number of counted pulses and the actual number of counted pulses obtained during the printer 101 is operated, it is detectable whether the feeding mechanism 13 is normally operating or not. That is, where a difference between the stored number of counted pulses and the actual number of counted pulses is equal to or larger than a threshold, it can be said that slippage is occurring between the feeder belt 8 and the belt roller 6, for instance. In this case, there is a possibility of defect such as contamination of the feeder belt 8 or the belt roller 6, presence of foreign matter between the feeder belt 8 and the belt roller 6, or wear or permanent deformation of the feeder belt 8.

Based on the detection or determination by the ink-droplet ejection-area detecting portion 82, the position determining portion 83 determines whether the leading end of either of the ink-droplet ejection areas 8*c* reaches the predetermined position. As shown in FIG. 4, the mask-signal outputting portion 84 outputs, when the position determining portion 83 determines that the leading end of the ink-droplet ejection area 8*c* reaches the predetermined position, a mask signal, which takes the form of a signal and is for masking the pulse of the detection signal that the position sensor 20 outputs upon detecting the leading end of the ink-droplet ejection area 8*c* reaching the predetermined position. It is noted that a rising edge of the pulse signal (mask signal) outputted from the mask-signal outputting portion 84 comes before the timing at which the leading end of the ink-droplet ejection area 8*c* reaches the predetermined position by a predetermined amount of time, and a falling edge of the mask signal comes after the timing at which the trailing end of the ink-droplet ejection area 8*c* have passed the predetermined position by a predetermined amount of time. Thus, the width of the pulse (mask signal) outputted from the mask-signal outputting portion 84 is W2, which is larger than the width W1 of the pulse of the detection signal.

As shown in FIGS. 3 and 4, the head control portion 85 operates to control, via a driver IC 52, ejection of ink droplets from the inkjet heads 1 in order that ink droplets are ejected from the nozzles at desired timings in accordance with the image data stored in the image-data storing portion 81. The ejection of ink droplets is implemented in either a normal printing operation or a test printing operation. The normal printing operation is implemented when an image is to be recorded on a recording sheet P, and the test printing operation is implemented in the nozzle inspection described later. In the test printing operation, the test pattern is printed on at least one of the ink-droplet ejection areas 8*c*. Switching between the normal and test printing operations is implemented in response to an instruction from an upper level computer, or an instruction inputted by a user through an operator panel.

In the normal printing operation, the head control portion 85 controls the inkjet heads 1 such that when a detection signal (a pulse) in the output (hereinafter referred to as "detection output") from the position sensor 20 is not masked by a mask signal in the output (hereinafter referred to as "mask output") from the mask-signal outputting portion 84, in other words, when a detection signal is outputted from the position sensor 20 and a mask signal is not outputted from the mask-signal outputting portion 84, the detection signal is detected from a logical sum output which represents a logical sum of the detection output and the mask output. Then, recording on the recording sheet P of the image desired to be recorded thereon is performed during a normal-printing implementation time, which is a period of time allocated for the normal printing operation and initiates when a predetermined first period of time has elapsed after the detection of the detection signal. The normal-printing implementation time corresponds to a period of time taken by an entirety of the recording sheet P to pass through an area under the inkjet heads 1, that is, between a moment when the leading end of the recording sheet P reaches the area and a moment when the trailing end of the recording sheet P have passed the area.

In the normal printing operation, the head control portion 85 controls the inkjet heads 1 also such that when a detection signal in the detection output is masked by a mask signal in the mask output, that is, when the detection signal is not detected from the logical sum output, recording of the image desired to be recorded on the recording sheet P is not performed during the normal-printing implementation time.

In the test printing operation, the head control portion 85 controls the inkjet heads 1 such that when a detection signal (a pulse) in the detection output is masked by a mask signal in the mask output, that is, when a detection signal is outputted from the position sensor 20 and a mask signal is outputted from the mask-signal outputting portion 84, printing of the test pattern on one of the ink-droplet ejection areas 8*c* is performed during a test-printing implementation period, which is a period of time allocated for the test printing operation and initiates when a second predetermined period of time has elapsed after the detection of the detection signal. The test-printing implementation period corresponds to a period of time between a moment when the leading end of the ink-droplet ejection area 8*c* reaches an area under one of the inkjet heads 1 and a moment when the trailing end of the ink-droplet ejection area 8*c* have passed the area under that inkjet head 1. The test printing operation is performed sequentially for the four inkjet heads 1, and the second predetermined period of time after which the test printing operation is initiated differs among the inkjet heads 1.

In the test printing operation, the head control portion 85 controls the inkjet head 1 also such that when a detection signal in the detection output is not masked by a mask signal in the mask output, printing of the test pattern is not performed during the test-printing implementation period.

The sheet-supply control portion 86 controls the sheet supply motor 35 on the basis of the result of the detection by the ink-droplet ejection-area detecting portion 82 and the speed at which the feeder belt 8 feeds the recording sheet P, in order to supply the recording sheet P onto the feeder belt 8 at such a timing as to place the recording sheet P within one of the sheet holding areas 8*b* that constitute the other part of the outer circumferential surface 8*a* of the feeder belt 8 than the ink-droplet ejection areas 8*c*. The sheet-supply control portion 86 constitutes a part of a placing mechanism.

There will be described in detail a relationship between the detection signal in the detection output of the position sensor 20 and the mask signal in the mask output of the mask-signal outputting portion 84. As shown in FIG. 4, while the feeder belt 8 is traveling at a steady speed, the ink-droplet ejection areas 8*c* repeatedly reach the predetermined position in a cycle T. Since the sheet-supply control portion 86 supplies a recording sheet P onto the feeder belt 8 such that the recording sheet P is placed within one of the sheet holding areas 8*b* on the outer circumferential surface 8*a* of the feeder belt 8, the recording sheet P does not overlap with the ink-droplet ejection areas 8*c* and reaches the predetermined position at a timing different from timings at which the ink-droplet ejection areas 8*c* reach the predetermined position. Thus, the timing at which the position sensor 20 outputs a detection signal indicative of either of the ink-droplet ejection areas 8*c* reaching the predetermined position is different from the timing at which the position sensor 20 outputs a detection signal indicative of the recording sheet P reaching the predetermined position. The detection signal indicative of the ink-droplet ejection areas 8*c* reaching the predetermined position is outputted in the cycle T.

Since the mask signals in the mask output are in synchronization with the timings at which the ink-droplet ejection areas 8*c* reach the predetermined position, the mask signals are also outputted in the cycle T. Further, the pulse width W2 of the mask signal is larger than the pulse width W1 of the detection signal, and each mask signal is outputted at such a timing that the pulse of the mask signal chronologically includes the corresponding detection signal, that is, the pulse of the mask signal rises before the pulse of the corresponding detection signal falls, and falls after the pulse of the corresponding detection signal rises. Thus, it is ensured that the mask signal masks the detection signal.

Only when a detection signal is outputted or detected from the logical sum output which is the logical sum of the detection output and the mask output, that is, only when the mask-signal outputting portion 84 does not output a mask signal for masking a detection signal outputted from the position sensor 20, the head control portion 85 operates to perform the normal printing operation on a recording sheet P such that the normal printing operation is initiated when the predetermined first period of time has elapsed after the output of the detection signal.

Only when a detection signal is masked by a mask signal, the test printing operation, i.e., the operation to print the test pattern on an ink-droplet ejection area 8*c*, is performed such that the test printing operation is initiated when the second predetermined period of time has elapsed after the output of the detection signal. As described above, the test printing operation is performed for each of the four inkjet heads 1 sequentially, and the second predetermined period of time is set at different lengths among the inkjet heads 1, depending on the distance between the position sensor 20 and each of the inkjet heads 1.

The test-pattern forming portion 87 operates to implement the test printing operation, that is, to have the head control portion 85 print the test pattern of nozzle inspection on at least one of the ink-droplet ejection areas 8*c*. For instance, the test pattern preferably takes the form of a bunch of straight lines formed by the respective nozzles such that the straight lines extend in the sheet feeding direction. Where the test pattern takes such a form, when there is an abnormal nozzle from which ink droplet ejection is defective, one of the straight lines that is expected to be formed by ink ejection from the nozzle is not normally formed.

The defective-ejection detecting portion 88 operates to detect an abnormal or defective nozzle in the nozzle inspection. More specifically, while the ink-droplet ejection area 8*c* on which the test pattern has been printed by the test-pattern forming portion 87 is passing under the image sensor 17, the defective-ejection detecting portion 88 reads by means of the image sensor 17 the straight lines of the test pattern that correspond to the respective nozzles. The defective-ejection detecting portion 88 determines whether each straight line of the test pattern is formed normally. When determining that any of the straight lines is not formed normally or at all, the defective-ejection detecting portion 88 concludes that the nozzle corresponding to the straight line abnormally formed, or not formed at all, cannot eject an ink droplet normally.

When any abnormal or defective nozzle is thus detected, a flushing operation is implemented for the abnormal or defective nozzle. In the flushing operation, an ink droplet is ejected from the nozzle onto the ink-droplet ejection area 8*c* in order to eliminate clogging of the nozzle and restore its ejection performance. A purging operation using a pump (not shown) may be implemented in the case where any abnormal or defective nozzle is detected. In the purging operation, ink is forcibly supplied to the inkjet head 1 having the abnormal or defective nozzle so as to forcibly discharge the ink from all of the nozzles of the inkjet head 1 onto the ink-droplet ejection area 8*c*. For example, the purging operation may be implemented in the case where any of the nozzles is still determined to be abnormal or defective after the flushing operation is repeated a predetermined number of times, which may be once. The purging operation includes a discharging step in which the ink is discharged, and a wiping step following the discharge step, in which the ink adhering to the ink ejection surface 2*a* of the inkjet head 1 is wiped off using a wiper (not shown). In the discharging step, the ink is discharged to a cap and an ink ejection tray (neither shown). The cap is for covering the ink ejection surface 2*a* of the inkjet head 1, and the ink ejection tray is interposed between the inkjet head 1 and the feeder belt 8.

The feed-motor control portion 89 controls the operating speed of the feed motor 19 so as to vary the traveling speed of the feeder belt 8 in a predetermined pattern.

The cleaning control portion 90 operates after the nozzle inspection, to make the cleaning mechanism 18 cleanse the ink-droplet ejection area 8*c* on which the test pattern has been printed. There will be described in detail the operation of the cleaning mechanism 18, referring to FIGS. 5A and 5B, which illustrate the operation of the cleaning mechanism 18, as seen from the lower side and a lateral side of the feeder belt 8, respectively.

Figure 5A:
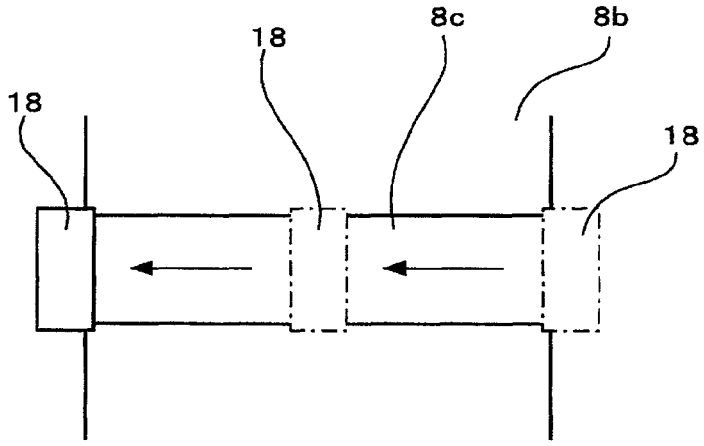
FIGS. 5 A and 5B illustrate an operation of a cleaning mechanism shown in FIG. 1.
Figure 5B:
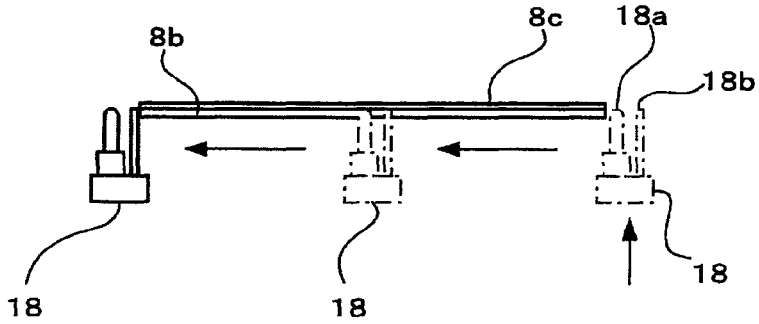

When placed in a waiting or standby state, the cleaning mechanism 18 is located below and on a lateral side of the feeder belt 8, as shown in FIGS. 5A and 5B. After the nozzle inspection, the cleaning control portion 90 locates the ink-droplet ejection area 8*c* at a cleaning position at which ink-droplet ejection area 8*c* is to be opposed to the cleaning mechanism 18, and elevates the cleaning mechanism 18 so as to have tips of the cleaning-liquid applicator 18*a* and the blade 18*b* contactable with the ink-droplet ejection area 8*c*. Thereafter, the cleaning control portion 90 moves the cleaning mechanism 18 leftward as seen in FIGS. 5A and 5B such that the cleaning mechanism 18 passes under and across the ink-droplet ejection area 8*c* with respect to the width direction of the feeder belt 8. At this time, the cleaning-liquid applicator 18*a* is located downstream of the blade 18*b* with respect to the moving direction of the cleaning mechanism 18. Hence, as the cleaning mechanism 18 moves, the cleaning-liquid applicator 18*a* applies the cleaning liquid on the ink-droplet ejection area 8*c* and the blade 18*b* removes the applied cleaning liquid. In this way, the ink-droplet ejection area 8*c* is cleansed. When the cleaning of the ink-droplet ejection area 8*c* is complete, the cleaning control portion 90 lowers the cleaning mechanism 18 and then moves the cleaning mechanism 18 rightward as seen in FIGS. 5A and 5B to again place the cleaning mechanism 18 in the standby state.

According to the above-described embodiment, the detection signal, which is outputted from the position sensor 20 when the ink-droplet ejection area 8*c* reaches the predetermined position, is masked by the mask signal outputted from the mask-signal outputting portion 84. Hence, it is prevented that printing to be performed on the recording sheet P is erroneously performed on either of the ink-droplet ejection areas 8*c*.

Since the sheet-supply control portion 86 supplies a recording sheet P onto the feeder belt 8 such that the recording sheet P is placed within either of the sheet holding areas 8*b* on the outer circumferential surface 8*a* of the feeder belt 8, the recording sheet P does not overlap with the ink-droplet ejection areas 8*c* and reaches the predetermined position at a timing different from the timings at which the ink-droplet ejection areas 8*c* reach the predetermined position. Hence, the timing at which the position sensor 20 outputs the detection signal indicative of that the ink-droplet ejection area 8*c* reaching the predetermined position is detected, is different from the timing at which the position sensor 20 outputs the detection signal indicative of that the recording sheet P reaching the predetermined position is detected. Thus, the detection signal outputted from the position sensor 20 when the recording sheet P reaches the predetermined position is not masked by the mask signal outputted from the mask-signal outputting portion 84. Therefore, it is prevented that the detection signal for the recording sheet P is erroneously masked by the mask signal, which would otherwise lead to that an image desired to be recorded on the recording sheet P is not recorded thereon. Since the recording sheet P does not contact the ink-droplet ejection areas 8*c*, the recording sheet P is free from contamination with the ink adhering to the ink-droplet ejection areas 8*c*. Since the recording sheet P is placed on the outer circumferential surface 8*a* of the feeder belt 8 such that an entire surface of the recording sheet P is on a surface having an adhesion, the recording sheet P is stably held on the outer circumferential surface 8*a*.

Since the ink-droplet ejection-area detecting portion 82 detects the position of each ink-droplet ejection area 8*c* on the feeder belt 8 on the basis of the output of the rotary encoder 31, the ink-droplet ejection-area detecting portion 82 can detect the position of the ink-droplet ejection area 8*c* with high reliability.

Although in the above-described embodiment the ink-droplet ejection-area detecting portion 82 detects the position of each ink-droplet ejection area 8*c* on the feeder belt 8 on the basis of the output of the rotary encoder 31, the way to detect the position of the ink-droplet ejection area 8*c* may be otherwise. For instance, the embodiment may be modified such that the ink-droplet ejection-area detecting portion 82 detects the position of the ink-droplet ejection area 8*c* on the basis of a detection signal that is outputted from the position sensor 20 when the ink-droplet ejection area 8*c* reaches the predetermined position while the feeder belt 8 is circulated at a predetermined speed without a recording sheet P held thereon. In such a modification, it is determined that the ink-droplet ejection area 8*c* reaches the predetermined position under the position sensor 20 when the detection signal is outputted from the position sensor 20. Thus, the position of the ink-droplet ejection area 8*c* is detectable. Further, it is possible to obtain the traveling position of the ink-droplet ejection area 8*c* by making a calculation using a time period having elapsed since the ink-droplet ejection area 8*c* reached the predetermined position, and information of the speed at which the feeder belt 8 has traveled during that time period. According to this modification, the position of the ink-droplet ejection area 8*c* is detectable by software processing without using the rotary encoder 31, whereby the cost is lowered.

Although there has been described one embodiment of the invention and one modification thereof, it is to be understood that the invention is not limited to the details of the embodiment and the modification, but may be embodied with various other modifications and improvements that may occur to those skilled in the art, without departing from the scope and spirit of the invention defined in the appended claims.

For instance, in the above-described embodiment the sheet-supply control portion 86 supplies the recording sheet P onto the feeder belt 8 in order that the recording sheet P is placed only on the other area in the outer circumferential surface 8*a* of the feeder belt 8 than the ink-droplet ejection areas 8*c*, namely, only on the sheet holding areas 8*b*. However, the embodiment may be modified such that as long as the leading end of the recording sheet P and the leading end of either of the ink-droplet ejection areas 8*c* do not coincide with each other, the recording sheet P can be placed on the ink-droplet ejection areas 8*c*.

In the embodiment, the detection signal that is outputted from the detection sensor 20 upon the ink-droplet ejection area 8*c* reaching the predetermined position is masked by the mask signal outputted from the mask-signal outputting portion 84. However, the invention is not limited thereto. For instance, the embodiment may be modified such that the head control portion 85 controls the ejection of ink droplets, taking account of two kinds of information, namely, the detection signal from the position sensor 20 and the determination made by the position determining portion 83. When such a modification is employed, the mask-signal outputting portion 84 can be omitted, thereby lowering the cost.

Further, in the embodiment the ink-droplet ejection-area detecting portion 82 detects the position of the ink-droplet ejection area 8*c* on the feeder belt 8 on the basis of the output of the rotary encoder 31. However, the feeder belt 8 may have a mark provided thereon, and the ink-droplet ejection-area detecting portion 82 detects the position of the ink-droplet ejection area 8*c* by detecting the mark. For instance, the mark may be constituted by a reflective member attached to the feeding surface or the outer circumferential surface of the feeder belt 8 on which a recording sheet P is held, or a groove or a hole formed on the feeder belt 8.

Although in the embodiment the ink-droplet ejection areas 8*c* are white in color, the color of the ink-droplet ejection areas 8*c* is not limited to white.

In the embodiment the outer circumferential surface 8*a* of the feeder belt 8 has a weak adhesion so as to adhesively hold the recording sheet P thereon. However, it may be arranged such that a large number of suction openings are formed in the outer circumferential surface of the feeder belt, and air is sucked from the inner side of the feeder belt through the suction openings in order to hold the recording sheet P on the outer circumferential surface of the feeder belt. Further, although in the embodiment two ink-droplet ejection areas 8*c* are formed at respective positions on the outer circumferential surface 8*a* of the feeder belt 8, it may arranged such that only a single ink-droplet ejection area 8*c* is formed on the outer circumferential surface 8*a*, or alternatively three or more ink-droplet ejection areas 8*c* are formed thereon. Where two or more ink-droplet ejection areas 8*c* are formed on the outer circumferential surfaces 8*a* of the feeder belt 8, it is preferable that the ink-droplet ejection areas 8*c* are equally spaced from one another with respect to the extending direction of the outer circumferential surface 8*a*, i.e., the belt traveling direction.

In the embodiment the invention is applied to an inkjet printer 101 in which a recording sheet P is fed by an endless feeder belt 8. However, the invention is equally applicable to an inkjet printer in which a recording sheet P is fed by being placed on an outer circumferential surface of a drum having a cylindrical shape.

What is claimed is:

1. A recording apparatus comprising:

a feeding mechanism which feeds a recording medium placed on a feeding surface;

a recording head which ejects a liquid droplet onto the recording medium on the feeding mechanism;

a position sensor which outputs a detection signal when the recording medium being fed by the feeding mechanism reaches a predetermined position, and also when a liquid-droplet ejection area formed at a part of the feeding surface reaches the predetermined position;

a determining portion which determines whether the liquid-droplet ejection area passes the predetermined position; and a recording-head controller which controls the recording head such that (i) when the detection signal is not outputted from the position sensor, the recording head does not eject a liquid droplet, (ii) when the detection signal is outputted from the position sensor and the determining portion determines that the liquid-droplet ejection area does not reach the predetermined position, the recording head records on the recording medium an image desired to be recorded on the recording medium, and (iii) when the detection signal is outputted from the position sensor and the determining portion determines that the liquid-droplet ejection area reaches the predetermined position, the recording head prints on the liquid-droplet ejection area an image desired to be printed on the liquid-droplet ejection area.

2. The recording apparatus according to claim 1, further comprising a liquid-droplet ejection-area detecting portion which detects the position of the liquid-droplet ejection area on the basis of a traveling position of the feeding surface, wherein the determining portion determines on the basis of a result of the detection by the liquid-droplet ejection-area detecting portion whether the liquid-droplet ejection area reaches the predetermined position.

3. The recording apparatus according to claim 2, wherein the liquid-droplet ejection-area detecting portion detects the position of the liquid-droplet ejection area on the basis of the detection signal as outputted from the position sensor when the liquid-droplet ejection area reaches the predetermined position while the feeding mechanism is operated without the recording medium placed on the feeding surface.

4. The recording apparatus according to claim 1, further comprising a signal outputting portion which outputs a mask signal when the determining portion determines that the liquid-droplet ejection area reaches the predetermined position.

5. The recording apparatus according to claim 4, wherein to the recording-head controller is inputted the mask signal in combination with the detection signal outputted from the position sensor, and the recording-head controller controls the recording head on the basis of the inputted combination of the signals.

6. The recording apparatus according to claim 5, wherein the mask signal is a pulse signal for masking the detection signal.

7. The recording apparatus according to claim 5, wherein the signal outputting portion outputs the mask signal on the basis of a time interval between a first moment at which the position sensor detects that the liquid-droplet ejection area reaches the predetermined position, and a second moment at which the next time the position sensor detects that the liquid-droplet ejection area reaches the predetermined position, while the feeding mechanism feeds the recording medium at a steady speed.

8. The recording apparatus according to claim 6, wherein the detection signal outputted from the position sensor is a pulse signal whose pulse width varies depending on whether the detection signal is outputted upon detection of the recording medium or the liquid-droplet ejection area, and corresponds to a period of time taking which an entirety of the detected one of the recording medium and the liquid-droplet ejection area passes through the predetermined position, and wherein the pulse width of the pulse of the mask signal outputted from the signal outputting portion is larger than the pulse width of the detection signal as outputted when the liquid-droplet ejection area passing the predetermined position is detected.

9. The recording apparatus according to claim 1, further comprising a placing mechanism which places the recording medium on the feeding surface in order that the recording medium reaches the predetermined position at a timing different from a timing at which the liquid-droplet ejection area reaches the predetermined position.

10. The recording apparatus according to claim 9, wherein the placing mechanism places the recording medium on the feeding surface such that the recording medium is located within an area on the feeding surface other than the liquid-droplet ejection area.

11. The recording apparatus according to claim 2, wherein the feeding mechanism includes an endless feeder belt which is wound around a plurality of rollers and whose outer circumferential surface constitutes the feeding surface, and wherein the liquid-droplet ejection-area detecting portion detects the position of the liquid-droplet ejection area on the basis of the detection signal as outputted from the position sensor when the liquid-droplet ejection area reaches the predetermined position while the feeder belt is circulated without the recording medium placed on the feeding surface.

12. The recording apparatus according to claim 2, wherein the feeding mechanism includes an endless feeder belt which is wound around a plurality of rollers and whose outer circumferential surface constitutes the feeding surface, wherein the apparatus further comprises a traveling-position detecting portion which detects a traveling position of the feeder belt, and wherein the liquid-droplet ejection-area detecting portion detects the position of the liquid-droplet ejection area on the basis of the traveling position of the feeder belt detected by the traveling-position detecting portion.

13. The recording apparatus according to claim 12, wherein the liquid-droplet ejection-area detecting portion stores one of (a) an interval between the traveling position as detected by the traveling-position detecting portion when the position sensor detects that the liquid-droplet ejection area reaches the predetermined position, and the traveling position as detected by the traveling-position detecting portion when the next time the position sensor detects that the liquid-droplet ejection area reaches the predetermined position, and (b) a mean value of a plurality of the intervals, the liquid-droplet ejection-area detecting portion detecting, when the position sensor detects that the liquid-droplet ejection area reaches the predetermined position, the position of the liquid-droplet ejection area on the feeder belt on the basis of the stored one of the interval and the mean value of the intervals and by using as a reference the traveling position detected by the traveling-position detecting portion.

14. The recording apparatus according to claim 12, further comprising a pulse generator which generates a pulse signal in synchronization with circulation of the feeder belt, wherein the traveling-position detecting portion detects the traveling position of the feeder belt on the basis of the number of pulses generated by the pulse generator between a moment when the position sensor detects the liquid-droplet ejection area reaching the predetermined position and a moment when the next time the position sensor detects the liquid-droplet ejection area reaching the predetermined position, while the feeder belt is circulated without the recording medium placed on the feeding surface.

15. The recording apparatus according to claim 1, wherein the liquid-droplet ejection area is white in color.

16. The recording apparatus according to claim 1, wherein in a normal printing operation the recording-head controller controls the recording head such that when the position sensor outputs the detection signal and the determining portion determines that the liquid-droplet ejection area does not reach the predetermined position, the recording head records on the recording medium an image desired to be recorded, and when the position sensor outputs the detection signal and the determining portion determines that the liquid-droplet ejection area reaches the predetermined position, the recording head does not record on the liquid-droplet ejection area the image desired to be recorded on the recording medium.

17. The recording apparatus according to claim 1, wherein in a test printing operation the recording-head controller controls the recording head such that when the position sensor outputs the detection signal and the determining portion determines that the liquid-droplet ejection area does not reach the predetermined position, the recording head does not print on the recording medium a test pattern for inspection of the recording head, and when the position sensor outputs the detection signal and the determining portion determines that the liquid-droplet ejection area reaches the predetermined position, the recording head prints the test pattern on the liquid-droplet ejection area.

18. The recording apparatus according to claim 2, wherein the feeding mechanism includes a feed motor having a rotatable portion for feeding the feeding surface, and the liquid-droplet ejection-area detecting portion detects the position of the liquid-droplet ejection-area detecting portion on the basis of a rotating position of the rotatable portion.

19. The recording apparatus according to claim 18, further comprising a rotary encoder which outputs a pulse signal in synchronization with a rotation of the rotatable portion of the feeding mechanism, wherein the liquid-droplet ejection-area detecting portion detects the position of the liquid-droplet ejection area on the basis of the pulse signal outputted from the rotary encoder.

* * * * *